US010896645B2

(12) United States Patent
Lee et al.

(10) Patent No.: US 10,896,645 B2
(45) Date of Patent: Jan. 19, 2021

(54) FOLDABLE DISPLAY DEVICE

(71) Applicant: Samsung Display Co., LTD., Yongin-si (KR)

(72) Inventors: Seung-Jun Lee, Hwaseong-si (KR); Hyo-Jin Lee, Yongin-si (KR); Hui Nam, Yongin-si (KR); Myung-Ho Lee, Anyang-si (KR)

(73) Assignee: Samsung Display Co., Ltd. (KR)

( * ) Notice: Subject to any disclaimer, the term of this patent is extended or adjusted under 35 U.S.C. 154(b) by 13 days.

(21) Appl. No.: 15/729,194

(22) Filed: Oct. 10, 2017

(65) Prior Publication Data

US 2018/0102096 A1 Apr. 12, 2018

(30) Foreign Application Priority Data

Oct. 10, 2016 (KR) ..... 10-2016-0130706

(51) Int. Cl.

*G09G 3/3266* (2016.01)
*G09G 3/00* (2006.01)
*G09G 3/3275* (2016.01)

(52) U.S. Cl.

CPC ..... *G09G 3/3266* (2013.01); *G09G 3/006* (2013.01); *G09G 3/3275* (2013.01); *G09G 2310/0213* (2013.01); *G09G 2310/0218* (2013.01); *G09G 2310/0221* (2013.01); *G09G 2310/0286* (2013.01); *G09G 2380/02* (2013.01)

(58) Field of Classification Search

CPC .... G09G 3/3266; G09G 3/006; G09G 3/3275; G09G 2310/0213; G09G 2310/0218; G09G 2310/0221; G09G 2310/0286; G09G 2380/02

See application file for complete search history.

(56) References Cited

U.S. PATENT DOCUMENTS

2010/0097366 A1* 4/2010 Kitayama ..... G09G 3/3614 345/213
2011/0018857 A1* 1/2011 Lai ..... G09G 3/344 345/213

(Continued)

FOREIGN PATENT DOCUMENTS

KR 10-2012-0079610 A 7/2012
KR 10-2014-0001607 A 1/2014

(Continued)

*Primary Examiner* — Kent W Chang
*Assistant Examiner* — Sujit Shah
(74) *Attorney, Agent, or Firm* — Innovation Counsel LLP

(57) ABSTRACT

A foldable display device according to example embodiments includes a flexible display panel including a first display area having at least partially foldable area and a second display area not having the foldable area, a folding sensor in the first display area configured to detect a folding status of the flexible display panel and output a detecting signal which includes the folding status of the flexible display panel, a scan driver configured to sequentially provide scan signals to at least a part of a plurality of scan lines based on the detecting signal, a data driver configured to provide data signals to the flexible display panel based on the detecting signal, and a timing controller configured to convert input image data into corrected image data based on the detecting signal and control the scan driver and the data driver.

5 Claims, 7 Drawing Sheets

(56) References Cited

U.S. PATENT DOCUMENTS

| | | | | |
|---|---|---|---|---|
| 2013/0088479 | A1* | 4/2013 | Kim | G09G 3/3614 345/212 |
| 2014/0340431 | A1* | 11/2014 | Yamakawa | G09G 3/3426 345/690 |
| 2015/0022515 | A1* | 1/2015 | Ikeda | G09G 3/3275 345/212 |
| 2015/0146387 | A1* | 5/2015 | Lee | G06F 1/1679 361/749 |
| 2015/0316976 | A1* | 11/2015 | Toyotaka | G06F 1/3265 361/679.27 |
| 2016/0085325 | A1* | 3/2016 | Lee | G06K 9/00288 345/173 |
| 2016/0132721 | A1* | 5/2016 | Bostick | G06F 21/60 382/118 |
| 2016/0163282 | A1* | 6/2016 | Hsieh | G09G 5/006 345/681 |
| 2016/0274718 | A1* | 9/2016 | Burr | G06F 3/0416 |
| 2016/0275774 | A1* | 9/2016 | Bostick | G06F 1/1652 |

FOREIGN PATENT DOCUMENTS

| | | | |
|---|---|---|---|
| KR | 10-2014-0016082 | A | 2/2014 |
| KR | 10-2015-0067567 | A | 6/2015 |
| KR | 10-2016-0052940 | A | 5/2016 |

* cited by examiner

FOLDABLE DISPLAY DEVICE

CROSS REFERENCE TO RELATED APPLICATION

This application claims priority to and the benefit of Korean Patent Application No. 10-2016-0130706, filed on Oct. 10, 2016 in the Korean Intellectual Property Office (KIPO), the disclosure of which is hereby incorporated by reference herein in its entirety.

BACKGROUND

1. Field

Example embodiments of the inventive concept relate to display devices. More particularly, example embodiments of the inventive concept relate to foldable display devices having foldable areas in at least a portion of a display panel.

2. Discussion of Related Art

An organic light emitting display device displays images using organic light emitting diodes. The organic light emitting display device is used in a flexible display device, a rollable display device, a foldable display device, and the like.

In general, a scanning method for display panel is performed by dividing a display area into upper and lower display areas. However, since the scanning method requires a plurality of pre-decoders for driving the scanning operation of the upper and lower display areas, the wiring structure is complicated and the bezel size is increased.

Meanwhile, in a foldable (flexible) display device, when a part of the display panel is folded, the folded portion is not viewed by a user, so that a signal supply to the folded portion is unnecessary.

SUMMARY

Example embodiments provide a foldable display device controlling outputs of scan signals by detecting a folding of a display panel.

According to example embodiments, a foldable display device may comprise a flexible display panel including a first display area having at least partially foldable area and a second display area not having the foldable area, each of the first display area and the second display area having a plurality of pixels, a folding sensor in the first display area, the folding sensor being configured to detect a folding status of the flexible display panel and output a detecting signal which includes the folding status of the flexible display panel, a scan driver configured to sequentially provide scan signals to at least a part of a plurality of scan lines based on the detecting signal, a data driver configured to provide data signals to the flexible display panel based on the detecting signal, and a timing controller configured to convert input image data into corrected image data based on the detecting signal and control the scan driver and the data driver.

In example embodiments, the scan driver may comprise a scan controller configured to output a first scan control signal and a second scan control signal based on the detecting signal, a first sub scan driver configured to receive the first scan control signal and apply the scan signals to scan lines of a first scan line group in the first display area, and a second sub scan driver configured to receive the second scan control signal and apply the scan signals to scan lines of a second scan line group in the second display area of the flexible display panel.

In example embodiments, the first sub scan driver and the second sub scan driver may sequentially output the scan signals to the plurality of scan lines.

In example embodiments, the first scan driver and the second scan driver may sequentially apply the scan signals to all the scan lines when the folding sensor determines that the flexible display panel is unfolded.

In example embodiments, the second sub scan driver may sequentially apply the scan signal to the scan lines of the second scan line group when the folding sensor determines that the flexible display panel is folded. The first sub scan driver may not apply the scan signal to the scan lines of the first scan line group when the folding sensor determines that the flexible display panel is folded.

In example embodiments, the data signals may be applied to only the pixels in the second display area when the folding sensor determines that the flexible display panel is folded.

In example embodiments, the first sub scan driver and the second sub scan driver may be driven as a decoder type.

In example embodiments, the timing controller may be configured to correct the input image data to resize an image displayed on the flexible display panel based on the detect signal.

According to example embodiments, a foldable display device may comprise a flexible display panel including a plurality of pixels corresponding to first to 2N-th scan lines, and including a first display area having at least partially foldable area and a second display area not having the foldable area, a folding sensor in the first display area configured to detect a folding of the flexible display panel and output a detecting signal, a first scan driver configured to sequentially provide scan signals to a first scan line group among the first to 2N-th scan lines based on the detecting signal, a second scan driver configured to sequentially provide the scan signals to a second scan line group among the first to 2N-th scan lines based on the detecting signal, a data driver configured to provide data signals to the flexible display panel based on the detecting signal, and a timing controller configured to convert input image data based on the detecting signal and control the first scan driver, the second scan driver, and the data driver, where N is a positive integer.

In example embodiments, the first scan line group may include scan lines having a predetermined interval among the first to 2N-th scan lines.

In example embodiments, the first scan line group may include odd scan lines.

In example embodiments, the first scan line group may include even scan lines.

In example embodiments, the second scan line group may include all scan lines in the second display area of the flexible display panel.

In example embodiments, the scan signals may be applied to the scan lines in the first scan line group such that an image displays on the first display area and the second display area when the folding sensor determines that the flexible display panel is unfolded.

In example embodiments, the number of the scan lines in the first scan line group may be the same as the number of the scan lines in the second scan line group.

In example embodiments, the first scan driver may operate when the folding sensor determines that the flexible display panel is unfolded. The second scan driver may not operate when the folding sensor determines that the flexible display panel is unfolded.

In example embodiments, the image may be displayed on the first display area and the second display area when the first scan driver operates.

In example embodiments, the second scan driver may operate when the folding sensor determines that the flexible display panel is folded. The first scan driver may not operate when the folding sensor determines that the flexible display panel is folded.

In example embodiments, the image may be displayed on the second display area when the second scan driver operates. The data signals may not be transmitted to the first display area when the second scan driver operates.

In example embodiments, the timing controller may be configured to generate a selection signal for driving one of the first scan driver and the second scan driver based on the detecting signal. The one of the first scan driver and the second scan driver may operate based on the selection signal.

Therefore, the foldable display device according to example embodiments may include the folding sensor for detecting folding/rolling/bending and the scan driver for providing the scan signals to a part of the flexible display panel based on the detecting signal. Since scan signals and the data signals may not be provided to the first display area which is not viewed by the user according to the deformation of the flexible display panel, the power consumption of the foldable display device may be reduced.

BRIEF DESCRIPTION OF THE DRAWINGS

Example embodiments can be understood in more detail from the following description taken in conjunction with the accompanying drawings, in which.

DETAILED DESCRIPTION OF EMBODIMENTS

Exemplary embodiments will be described more fully hereinafter with reference to the accompanying drawings, in which various embodiments are shown.

Figure 1:
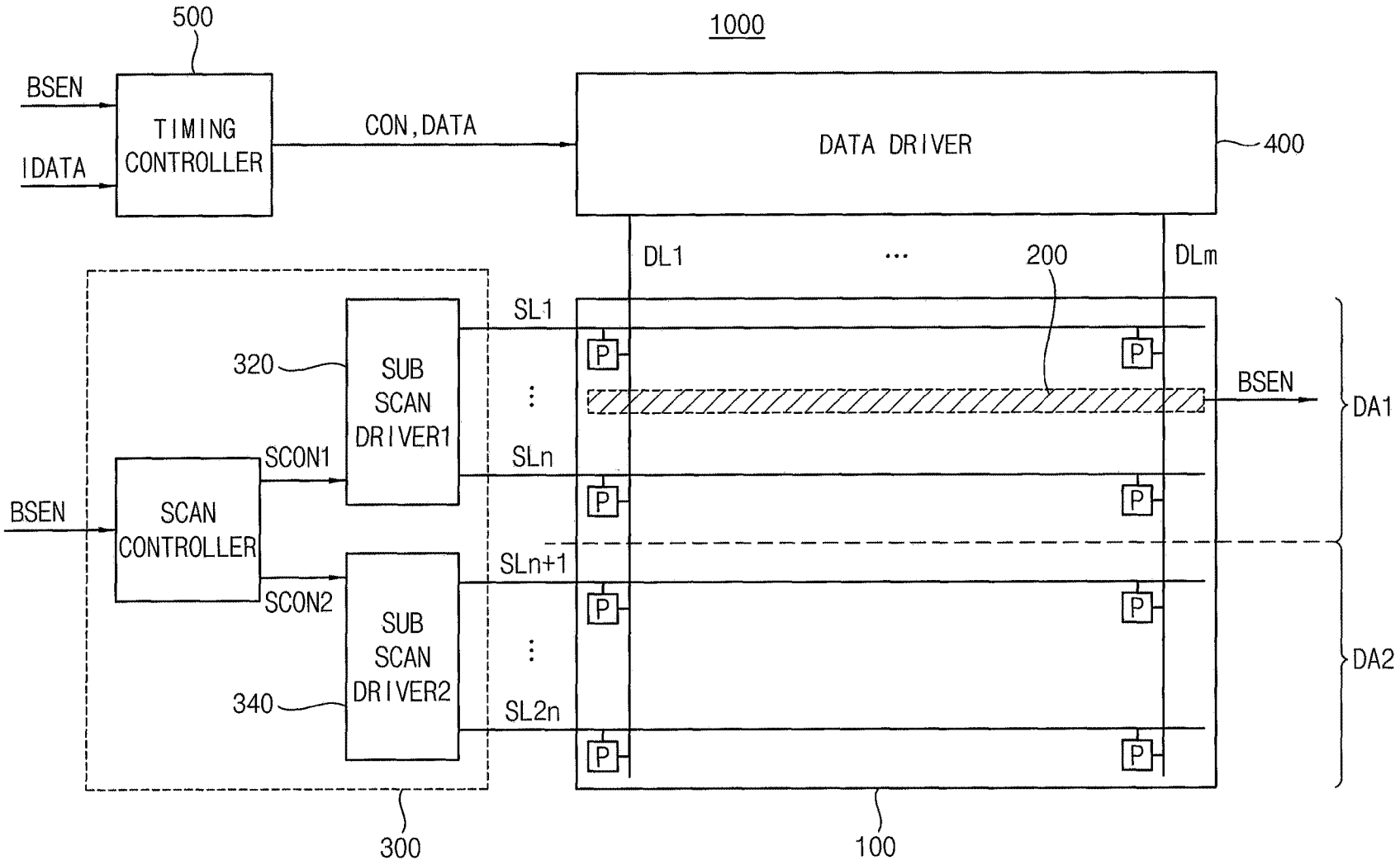
FIG. 1 is a block diagram of a foldable display device according to an example embodiment.

FIG. 1 is a block diagram of a foldable display device according to example embodiments.

Referring to FIG. 1, the foldable display device 1000 may include a display panel 100, a folding sensor 200, a scan driver 300, a data driver 400, and a timing controller 500.

The foldable display device 1000 may be an organic light emitting display device. The display device according to example embodiments is not limited to the foldable display device. For example, the display device may be implemented by a flexible display device such as a bendable display device, rollable display device, or the like.

The display panel (flexible display panel) 100 may include a plurality of pixels P to display an image. That is, the pixels P may be respectively arranged at locations corresponding to crossing regions of a plurality of scan lines SL1 to SL2*n* and a plurality of data lines DL1 to DLm, where n and m are integer greater than 1. The display panel 100 may include a first display area DA1 having at least partially foldable area. The display panel 100 may further include a second display area DA2 which is not to be folded. Since these are examples, the first and second display areas DA1 and DA2 are not limited thereto. For example, the display panel 100 may include a plurality of first display areas (i.e., a plurality of foldable or bendable display areas). For example, all parts of the display panel 100 may be fold or bent.

The folding sensor 200 may be arranged in the first display area DA1 to detect whether or not the display panel 100 is folded. In some embodiments, the folding sensor 200 may be disposed on a foldable or bendable portion.

The folding sensor 200 may have a characteristic that the resistance varies depending on a degree of bending. In some embodiments, the folding sensor 200 may be implemented as a strain gauge. For example, the strain gauge may detect the deformation of a surface of an object according to a change of the resistance by using a metal or a semiconductor whose resistance greatly changes according to a stress. The resistance of a material such as the metal may increase as the length increases with the stress and decrease as the length decreases. Therefore, it is possible to determine whether the display device 100 is folded or bended or not by the resistance changes.

The folding sensor 200 may detect the resistance of the folding sensor 200 using a magnitude of an applied voltage or a current flowing through the folding sensor 200 to detect a folding state (or a bending state) of a corresponding position. The folding sensor 200 may output a detecting signal BSEN based on the detected value. The folding sensor 200 may provide the detecting signal BSEN to the timing controller 500 or a controller in the foldable display device 1000.

In some embodiments, the folding sensor 200 may be disposed in the foldable (or bendable) area of the display panel 100. Accordingly, size, position, number, direction, etc. of the foldable area (or the bendable area) may be detected. In some embodiment, the detecting signal BSEN may include the information of the size, position, number, direction, etc. of the foldable area.

For example, the folding sensor 200 may determine that the display panel 100 is unfolded when the first display area DA1 is folded (or bent) below a predetermined threshold value. Then, the detecting signal BSEN may include the unfolding information. The folding sensor 200 may determine that the display panel 100 is folded when the first display area DA1 is folded (or bent) over the threshold value. In this case, the detecting signal BSEN may include the folding information.

The scan driver 300 may sequentially provide a plurality of scan signals to at least a part of the scan lines SL1 to SL2*n* based on the detecting signal BSEN. The scan driver 300 may sequentially provide the scan signals to the scan lines SL1 to SL2*n* when the display panel 100 is not folded or bent. Accordingly, the first and second display areas DA1 and DA2 may display the image. The scan driver 300 may sequentially provide the scan signals to only the scan lines SLn+1 to SL2*n* in the second display area DA2 when the folding sensor 200 determines that the display panel 100 is folded (or bent). Accordingly, the scan signals may be not provided to the scan lines SL1 to SLn in the first display area DA1 and only the second display area DA2 may display the image.

In some embodiments, the scan driver 300 may include a scan controller configured to output a first scan control signal SCON1 and a second scan control signal SCON2 based on the detecting signal BSEN, a first sub scan driver 320 configured to receive the first scan control signal SCON1 and apply the scan signals to the scan lines (e.g., SL1 to SLn) of a first scan line group in the first display area DA1, and a second sub scan driver 340 configured to receive the second scan control signal SCON2 and apply the scan signals to the scan lines (e.g., SLn+1 to SL2*n*) of a second scan line group in the second display area DA2. Since these are examples, the number of stage circuits in each of the first and second sub scan drivers 320 and 340, e.g., the numbers of scan lines connected to the first and second sub scan drivers 320 and 340 are not limited thereto. For example, the first sub scan driver 320 may cover about 90% of the total scan lines and the second sub scan driver 340 may cover about 10% of the total scan lines.

In some embodiments, the scan controller may include at least one decoder. Thus, operations of the first and second sub scan drivers 320 and 340 may be controlled by a selection signal output from the at least one decoder. For example, the selection signal may include the first and second scan control signals SCON1 and SCON2. In some embodiments, the scan controller may include a switch for controlling a frame start signal of the first and second sub scan drivers 320 and 340. Thus, the frame start signal may be applied to one of the first and second sub scan drivers 320 and 340 according to the switch control.

In some embodiments, the first and second sub scan drivers 320 and 340 may be connected to sequentially output the scan signals to the scan lines SL1 to SL2*n*. For example, in FIG. 1, the second sub scan driver 340 may be connected to the first sub scan driver 320 in dependent manner. Accordingly, when the display panel is not folded, the scan signals may be applied to the (N+1)-th scan line SLn+1 after the scan signals are applied to the N-th scan line SLn.

The first and second scan drivers 320 and 340 may operate to sequentially apply the scan signals to all the scan lines SL1 to SL2*n* when the folding sensor 200 determines that the display panel 100 is unfolded. In this, the frame start signal may be included in the first scan control signal SCON1. Accordingly, the first and second display areas DA1 and DA2 may display the image.

The second sub scan driver 340 may operate based on the second scan control signal SCON2 when the folding sensor 200 determines that the flexible display panel 100 is folded. The first sub scan driver 320 may not operate based on the first scan control signal SCON1 when the folding sensor 200 determines that the flexible display panel 100 is folded. Thus, data signals are applied to only the pixels P in the second display area DA2 when the folding sensor 200 determines that the flexible display panel 100 is folded. The frame start signal may be included in the second scan control signal SCON2.

In some embodiments, the scan controller, the first sub scan driver 320, and the second sub scan driver 340 may be driven as a decoder type. For example, each of the scan controller, the first sub scan driver 320, and the second sub scan driver 340 may include at least one decoder. The scan controller may generate the selection signal (e.g., the first and second scan control signals SCON1 and SCON2) based on the detecting signal BSEN. The first sub scan driver 320 and the second sub scan driver 304 may selectively output the scan signals based on the first and second scan control signals SCON1 and SCON2, respectively. Or, the first and second sub scan drivers 320 and 340 may sequentially output the scan signals based on the first and second scan control signals SCON1 and SCON2, respectively.

In some embodiments, the scan controller may be included in the timing controller 500.

The data driver 400 may generate the data signals based on a control signal CON and image data DATA received from the timing controller 500 and provide the data signals to the data lines DL1 to DLm.

The timing controller 500 may convert input image data IDATA into the corrected image data DATA and control the scan driver 300 and the data driver 400. A screen size on which the image is to be displayed may vary depending on the folding and unfolding of the display panel 100. Thus, the input image data IDATA may be corrected or regenerated to resize the image. Accordingly, the corrected image data DATA corresponding to the screen size of the display panel 100 to be viewed by a user may be provided to the data driver 400. By correcting the input image data IDATA according to the screen size, the image may be displayed without changing a resolution even the display panel 100 is deformed.

In other words, the first sub scan driver 320 may be connected to the scan lines located in the area not folded and the second sub scan driver 340 may be connected to the scan lines located in the area folded (e.g., not visible to the user if folded). Accordingly, only the first sub scan driver 320 may perform the scan operation when a portion of the display panel 100 is folded. And the first and second sub scan drivers 320 and 340 may sequentially perform the scan operation when the display panel 100 is unfolded.

As described above, the foldable display device 1000 according to example embodiments may include the folding sensor 200 for detecting folding/rolling/bending and the scan driver 300 for providing the scan signals to a part of the flexible display panel 100 based on the detecting signal BSEN. The scan signals and the data signals may not be provided to the first display area DA1 which is not viewed by the user. Thus, the power consumption of the foldable display device 1000 may be reduced.

Figure 2A:
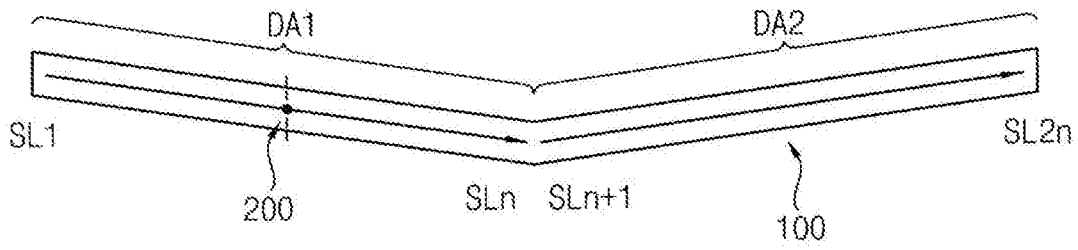
FIG. 2A is a diagram illustrating an example in which scan signals are provided to all pixels included in a display panel of the foldable display device of FIG. 1.
Figure 2B:
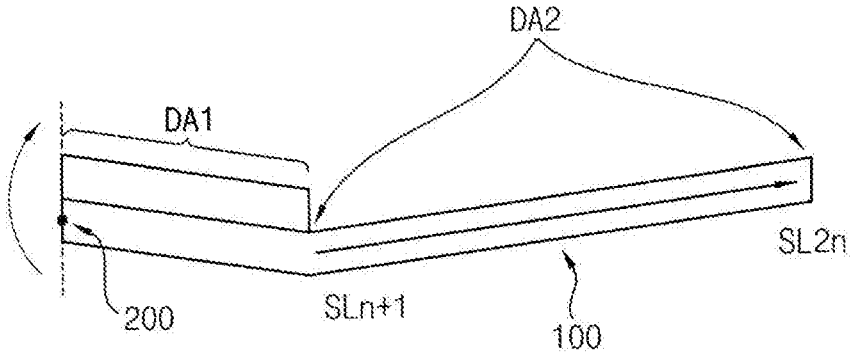
FIG. 2B is a diagram illustrating an example in which scan signals are provided to pixels in a second display area of a display panel of the foldable display device of FIG. 1.

FIG. 2A is a diagram illustrating an example in which scan signals are provided to all pixels included in a display panel of the foldable display device of FIG. 1. FIG. 2B is a diagram illustrating an example in which scan signals are provided to pixels in a second display area of a display panel of the foldable display device of FIG. 1.

Referring to FIGS. 1 to 2B, a displayable area (or a view screen size) may be varied according to a change of folding status of a flexible display panel 100 of the foldable display device 1000.

FIGS. 2A and 2B schematically show a cross section of the display panel 100.

The display panel 100 may include a first display area DA1 having at least partially foldable area and a second display area DA2 not having the foldable area. A folding sensor 200 may be arranged in the foldable area of the first display area DA1.

As illustrated in FIG. 2A, scan and data writing operations may be sequentially performed from a first scan line SL1 to a 2N-th scan line SL2*n* when the folding sensor 200 determines that the display panel 100 is not folded (or bent). Accordingly, all the pixels in the first and second display areas DA1 and DA2 may emit light and the first and second display areas DA1 and DA2 display an image.

As illustrated in FIG. 2B, the folding sensor 200 may detect the folding state when the first display area DA1 is folded. The scan signals may not be provided to the first to N-th scan lines SL1 to SLn in the first display area DA1. The scan signals may be sequentially provided to only the (N+1)-th scan line to 2N-th scan line SLn+1 to SL2*n* in the second display area DA2. Thus, the pixels in the second display area DA2 may emit light and only the second display area DA2 may display an image. In some embodiments, the first sub scan driver 320 corresponding to the first display area DA1 may not perform the scan operation and the second scan driver 320 corresponding to the second display area DA2 may perform the scan operation.

Figure 3:
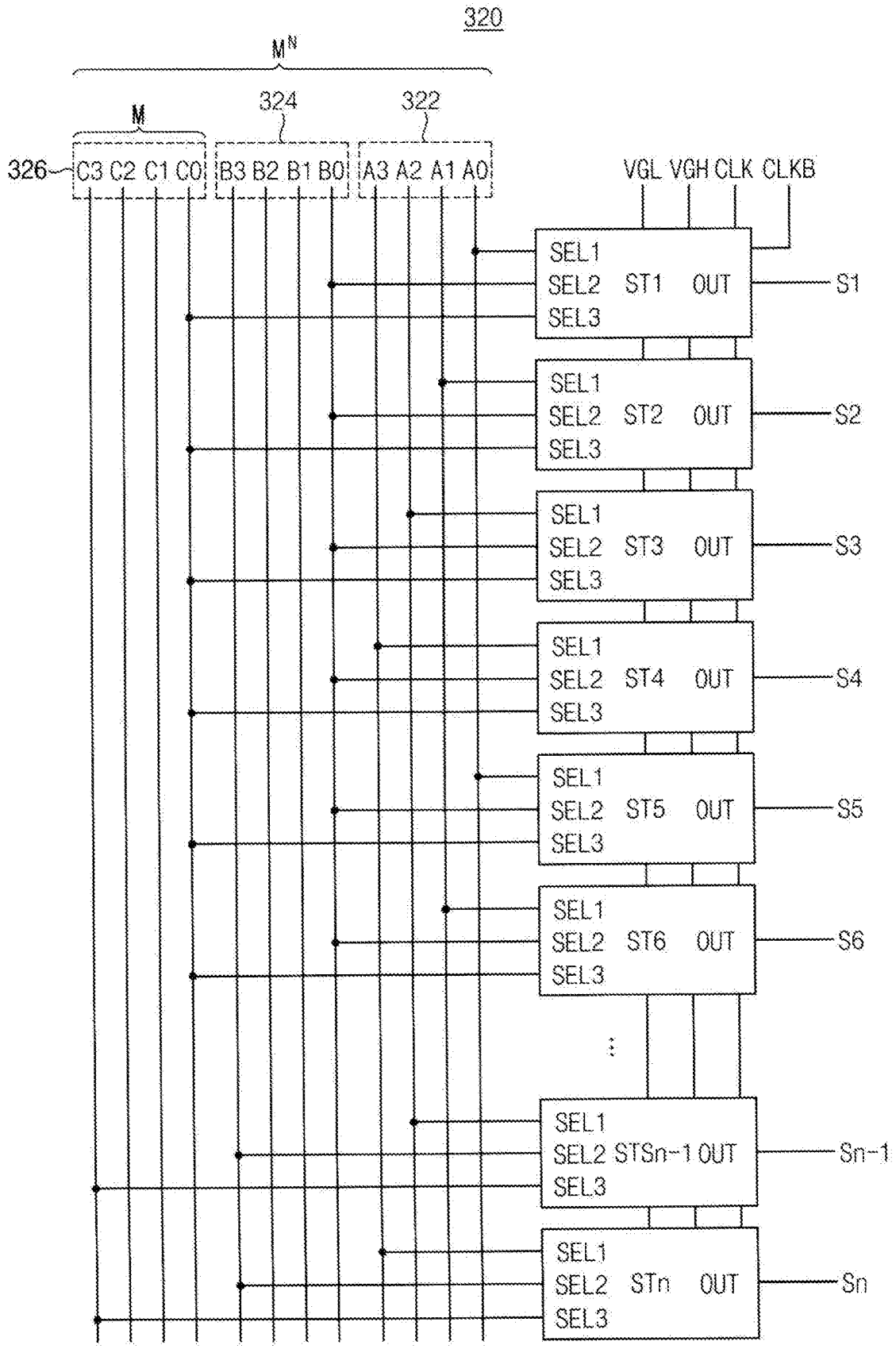
FIG. 3 is a diagram illustrating an example of sub scan drive in the foldable display device of FIG. 1.

FIG. 3 is a diagram illustrating an example of sub scan drive in the foldable display device of FIG. 1.

Referring to FIGS. 1 and 3, the first sub scan driver 320 may be a decoder type scan driver having a plurality of decoder stages ST1 to STn. The decoder stages ST1 to STn may output corresponding scan signals through a plurality of scan lines S1 to Sn, respectively.

In some embodiments, the scan driver 300 may include the scan controller, the first sub scan driver 320, and the second sub scan driver 340. The scan controller, the first sub scan driver 320, and the second sub scan driver 340 may be implemented as the decoder type.

In some embodiments, the scan controller may include decoder for selectively providing a frame start signal to one of the first and second sub scan drivers 320 and 340. The decoder may be controlled by the detecting signal BSEN.

Each of the stages of the first sub scan driver 320 (and the second sub scan driver 340) may include a first input terminal SEL1, a second input terminal SEL2, a third input terminal SEL3, and an output terminal OUT. Each of the stages ST1 through STn may receive a first direct current (DC) voltage VGH, a second DC voltage VGL, a first clock signal CLK, and a second clock signal CLKB.

In one embodiment, the second clock signal CLKB may be a signal inverted from the first clock signal CLK, and the second DC voltage VGL may be lower than the first DC voltage VGH.

The first sub scan driver 320 may select a scan line to which the scan signals are output based on voltage levels of a plurality of selection signals. In some embodiments, the first sub scan driver 320 may include a plurality of sub-decoders 322, 324, and 326 that selectively output the selection signals. For example, the first sub scan driver 320 may include N sub-decoders 322, 324, and 326, and each of the sub-decoders 322, 324, and 326 may output one of M selection signals, where N and M are integers greater than 2. Thus, the first sub scan driver 320 may selectively drive $M^N$ scan lines S1 to Sn. Because this is an example, the number of selection signals selected by the sub-decoders may be different from each other.

In FIG. 3, $4^3$ input signals are connected to the first to third input terminals SEL1, SEL2, and SEL3 of corresponding ones of the stages ST1 to STn, such that the first sub scan driver 320 may selectively drive 64 scan lines.

Each of the stages ST1 to STn may receive corresponding selection signals among the selection signals output from the sub-decoders 322, 324, and 326.

For example, for generating a scan signal provided to a first scan line S1, the first stage ST1 may receive an A0 signal of four selection signals (i.e., four selection signals indicated as A0, A1, A2, and A3) from the first sub-decoder 322, a B0 signal of four selection signals (i.e., four selection signals indicated as B0, B1, B2, and B3) from the second sub-decoder 324, and a C0 signal of four selection signals (i.e., four selection signals indicated as C0, C1, C2, and C3) from the third sub-decoder 326. The selection signals A0, B0, and C0 may be provided to the first to third selection terminals SEL1, SEL2, and SEL3.

The stage that received the selection signals may output the scan signal. Accordingly, the first sub scan driver 320 may output the scan signals to the scan lines S1 to Sn sequentially or selectively.

In some embodiments, the second sub scan driver 340 may have substantially the same configuration as the first sub scan driver 320.

Figure 4A:
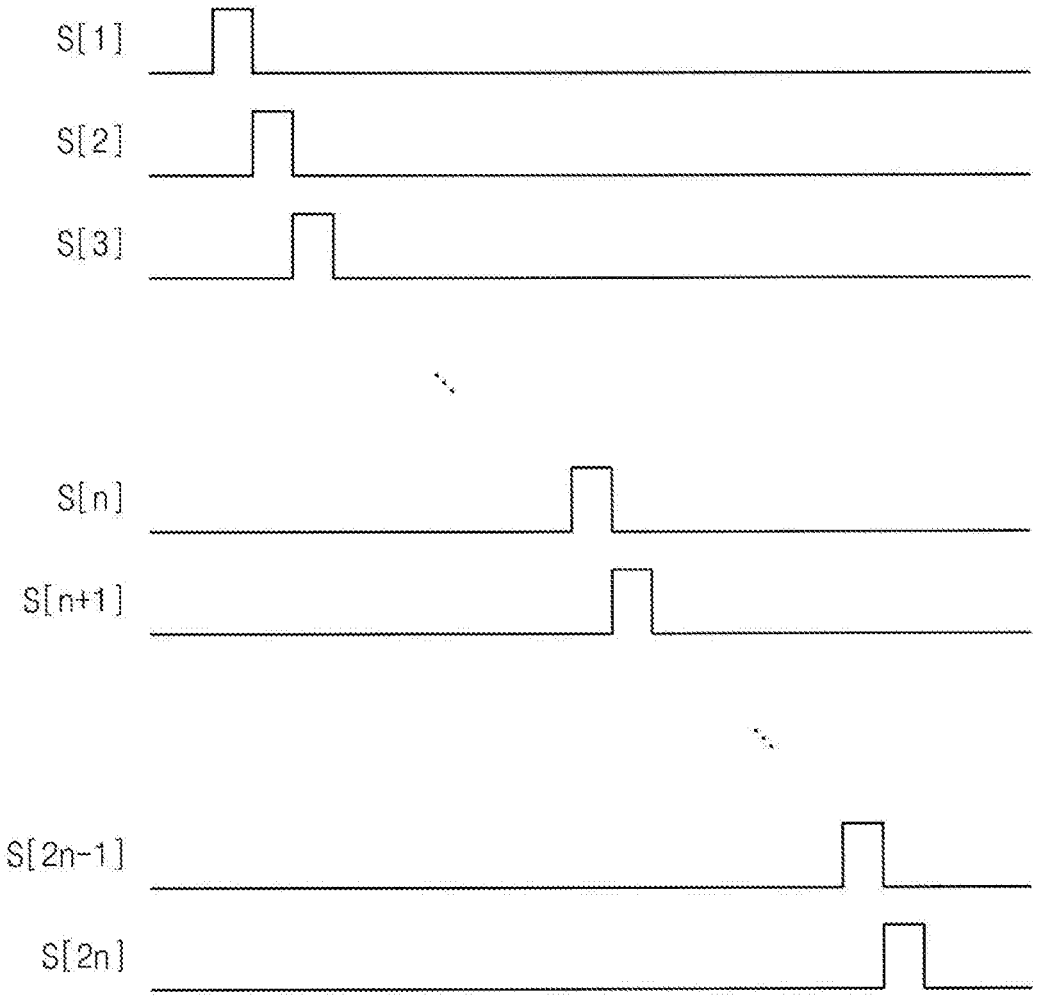
FIG. 4A is a timing diagram illustrating an example of scan signals output when the foldable display device of FIG. 1 is unfolded.
Figure 4B:
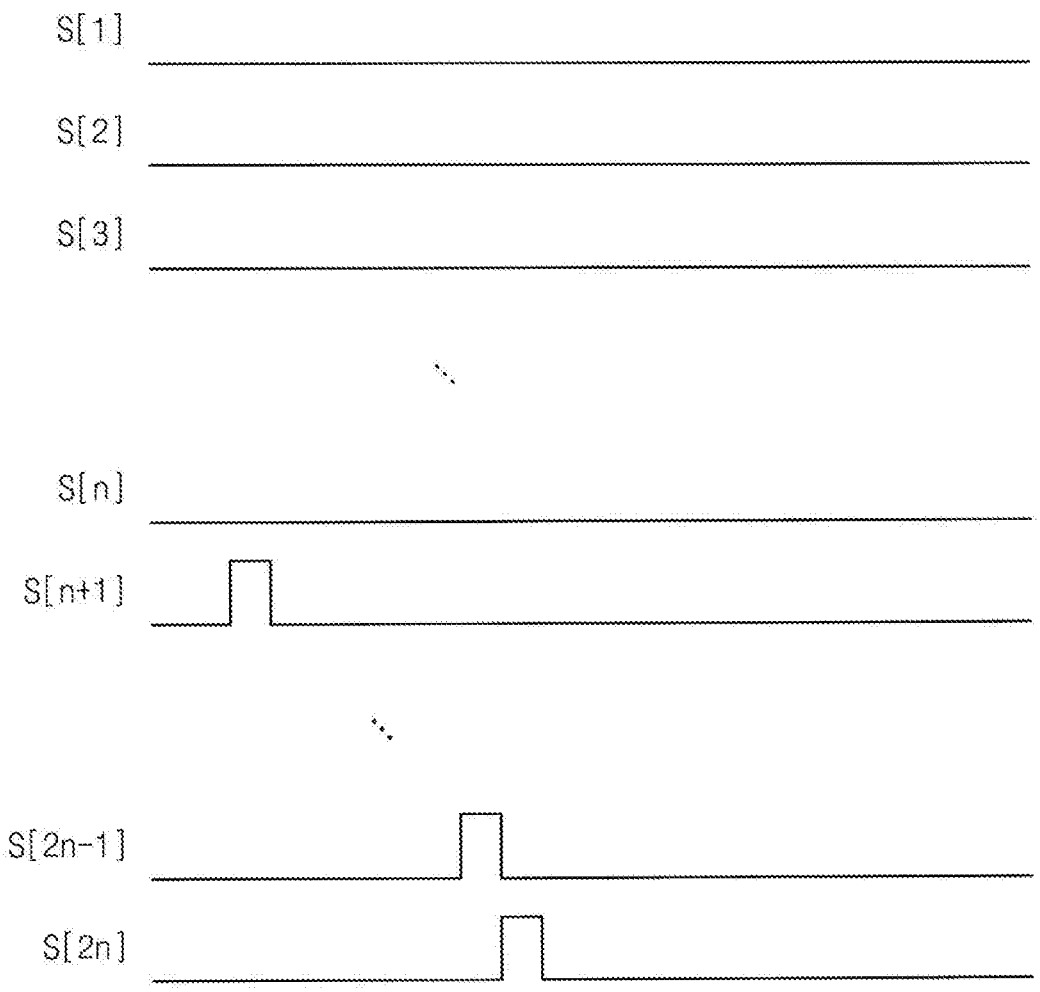
FIG. 4B is a timing diagram illustrating an example of scan signals output when the foldable display device of FIG. 1 is folded.

FIG. 4A is a timing diagram illustrating an example of scan signals output when the foldable display device of FIG. 1 is unfolded. FIG. 4B is a timing diagram illustrating an example of scan signals output when the foldable display device of FIG. 1 is folded.

Referring to FIGS. 1, 4A, and 4B, the scan driver 300 may provide the scan signals to all or part of the scan lines depending on the status (e.g., folding or unfolding) of the flexible display panel 100.

In some embodiments, as illustrated in FIG. 4A, the scan signals S[1] to S[2*n*] may be sequentially output through the scan lines of the first and second scan line groups when the folding sensor 200 determines that the display panel 100 is unfolded. Then the entire display panel 100 (the first and second display areas DA1 and DA2) may display an image. In some embodiments, the first sub scan driver 320 corresponding to the first display area DA1 and the second sub scan driver 340 corresponding to the second display area DA2 may output the scan signals S[1] to S[2*n*].

In some embodiments, as illustrated in FIG. 4B, the scan signals, i.e., only S[n+1] to S[2*n*], corresponding to the second display area DA2 may be sequentially output when the folding sensor 200 determines that the first display area DA1 of the display panel 100 is folded. The scan signals S[1] to S[n] corresponding to the first display area DA1 may not be output. Then the second display area DA2 of the display panel 100 may display an image. In some embodiments, image data may be corrected or regenerated to resize the image when the folding sensor 200 determines that the first display area DA1 of the display panel 100 is folded. Thus, the display resolution may not be change even if the flexible display panel 100 is folded.

As described above, the foldable display device 1000 according to example embodiments may include the folding sensor for detecting folding/rolling/bending 200 and the scan driver 300 for providing the scan signals to a part of the flexible display panel 100. The scan signals and the data signals may not be provided to the first display area DA1 which is not viewed by the user. Thus, the power consumption of the foldable display device 1000 may be reduced.

Figure 5:
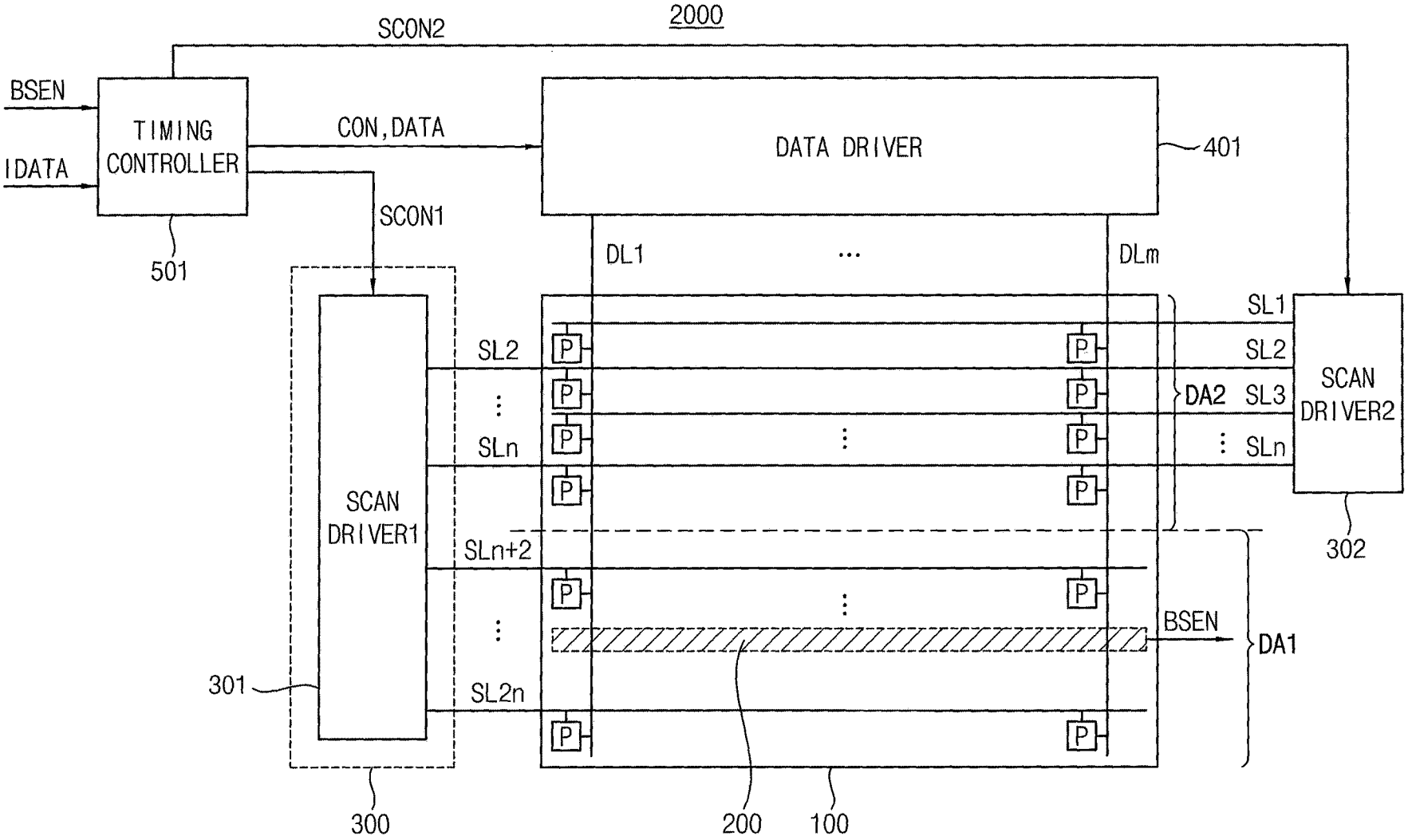
FIG. 5 is a block diagram of a foldable display device according to another example embodiment.

FIG. 5 is a block diagram of a foldable display device according to example embodiments.

In FIG. 5, like reference numerals are used to designate elements of the foldable display device the same as those in FIG. 1, and detailed description of these elements may be omitted. The foldable display device of FIG. 5 may be substantially the same as or similar to the foldable display device of FIG. 1 except for the scan driver and the timing controller.

Referring to FIG. 5, the foldable display device 2000 may include a flexible display panel 100, a folding sensor 200, a first scan driver 301, a second scan driver 302, a data driver 401, and a timing controller 501.

The display panel (flexible display panel) 100 may include a plurality of pixels P to display an image. The display panel 100 may include a first display area DA1 having at least partially foldable area. The display panel 100 may further include a second display area DA2 which does not have the foldable area. Since these are examples, the first and second display areas DA1 and DA2 are not limited thereto. For example, the display panel 100 may include a plurality of first display areas (i.e., a plurality of foldable or bendable display areas). For example, all parts of the display panel 100 may be folded or bent.

The folding sensor 200 may be arranged in the first display area DA1 to detect a folding state of the display panel 100. In some embodiments, the folding sensor 200 may be disposed on a foldable or bendable portion. The folding sensor 200 may output a detecting signal BSEN based on a detected value. The folding sensor 200 may provide the detecting signal BSEN to the timing controller 501 or a controller in the foldable display device 2000.

The first scan driver 301 may sequentially provide scan signals to a plurality of scan lines in a first scan line group of the first to 2N-th scan lines SL1 to SL2*n* based on the detecting signal BSEN. In some embodiments, the first scan line group may include scan lines having a predetermined interval among the first to 2N-th scan lines SL1 to SL2*n*. For example, as illustrated in FIG. 5, the first scan line group may include even scan lines SL2, . . . , SLn, SLn+2, . . . , SL2*n*. In contrast, the first scan line group may include odd scan lines SL1, SL3, . . . , SLn−1, . . . , SL2*n*−1. However, configurations of the first scan line group are not limited thereto. The first scan line group may include the scan lines having a certain interval such that the image can be displayed on the entire display panel 100. For example, the first scan line group may include the scan lines corresponding to every 3 or 4 pixel row.

In some embodiments, the first scan driver 301 may operate when the folding sensor 200 determines that the display panel 100 is unfolded. The second scan driver 302 may not operate when the folding sensor 200 determines that the display panel 100 is unfolded. The scan signals may be applied to the scan lines corresponding to the first scan ling group by the first scan driver 301. Thus, for example, as illustrated in FIG. 5, the pixels P corresponding to the even scan lines SL2, . . . , SLn+2, . . . , SL2*n* may emit light and the first and second display areas DA1 and DA2 may display the image.

In some embodiments, the first scan driver 301 may not operate when the folding sensor determines that the display panel 100 is folded. Accordingly, the scan signals may not be applied to the scan lines SLn+1 to SL2*n* corresponding to the first display area DA1.

The second scan driver 302 may sequentially provide the scan signals to a second scan line group of the first to 2N-th scan lines SL1 to SL2*n* based on the detecting signal BSEN. In some embodiments, the second scan line group may include all scan lines in the second display area DA2. For example, as illustrated in FIG. 5, the second scan line group may include first to N-th scan lines SL1 to SLn included in the second display area DA2. In some embodiment, the number of scan lines of the first scan line group may be the same as the number of the scan lines of the second scan lines group. Since the data signals may be applied to the same number of pixel rows even if the screen size changes, it is not required to correct or regenerate the image data. Thus, complicated image data processing due to the change of the folding status of the display panel 100 may be eliminated.

In some embodiments, the second scan driver 302 may not operate when the folding sensor 200 determines that the display panel 100 is unfolded. Further, in some embodiments, the second scan driver 302 may operate when the folding sensor 200 determines that the display panel 100 is folded. When the scan diver 302 operate, the image may be displayed on only the second display area DA2 and the data signals may not be applied to the first display area DA1.

The data driver 401 may generate the data signals based on a control signal CON and image data DATA received from the timing controller 501 and provide the data signals to the data lines DL1 to DLm.

The timing controller 501 may convert input image data IDATA into the image data DATA and control the first scan driver 301, the second scan driver 302, and the data driver 401 based on the detecting signal BSEN. In some embodiments, the timing controller 501 may generate selection signals SCON1 and SCON2 for driving one of the first and second scan drivers 301 and 302 based on the detecting signal BSEN.

In other words, the foldable display device 2000 may include the first scan driver 301 (or a plurality of first scan drivers) that operates only when the display panel 100 is unfolded, and the second scan driver 302 (or a plurality of second scan drivers) that operates only when the display panel 100 is folded.

As described above, the foldable display device according to example embodiments may include the folding sensor 200 to detect folding/rolling/bending state and the scan drivers 301 and 302 to provide the scan signals to a portion of the flexible display panel 100. The scan signals and the data signals may not be provided to the first display area DA1 which is not viewed by the user. Thus, the power consumption of the foldable display device 1001 may be reduced. In addition, complicated image data processing due to change of the folding status of the display panel 100 may be eliminated.

Figure 6:
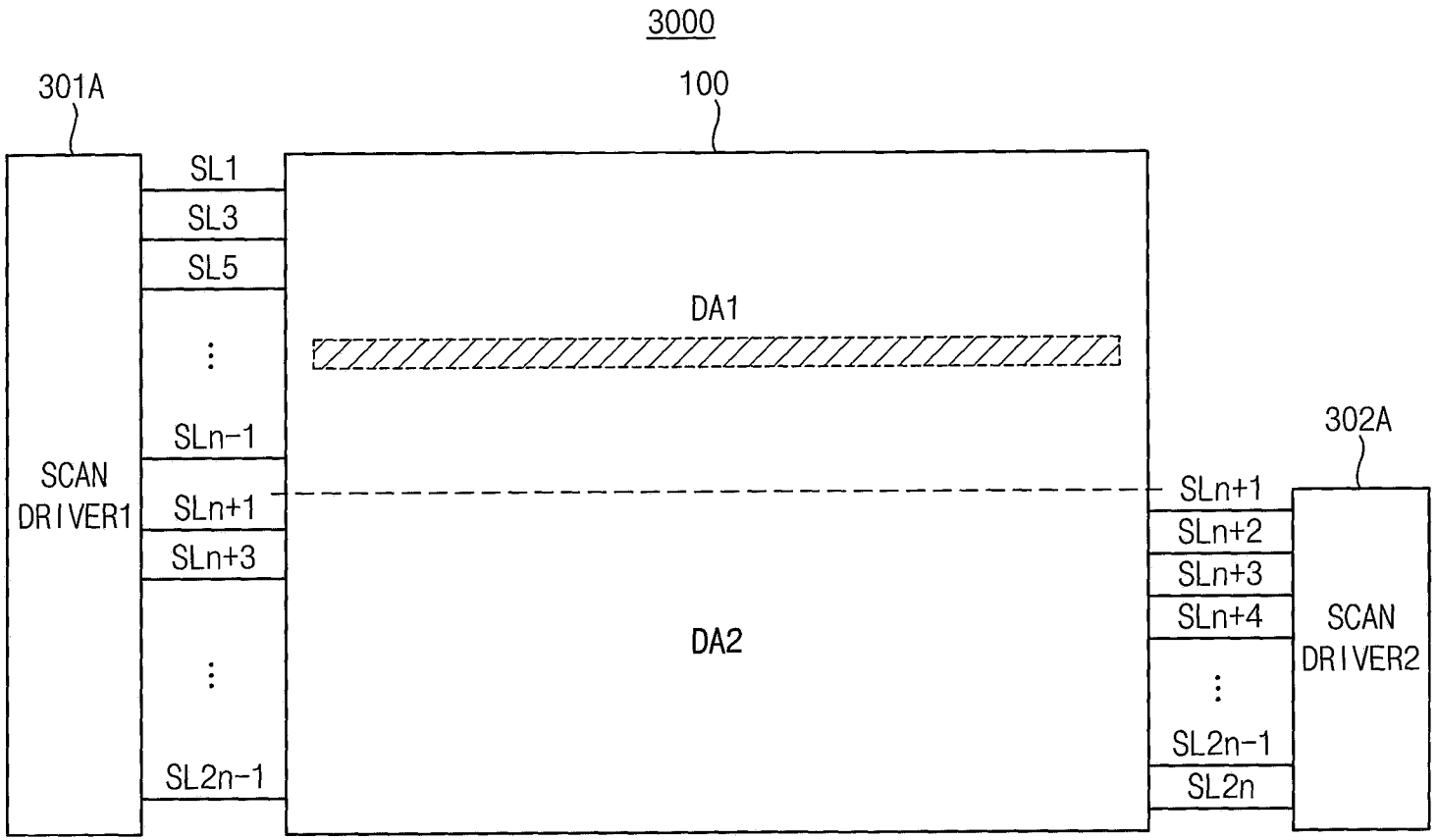
FIG. 6 is a block diagram illustrating an example of an arrangement of scan drives in the foldable display device of FIG. 5.

FIG. 6 is a block diagram illustrating an example of an arrangement of scan drives in the foldable display device of FIG. 5.

Referring to FIGS. 5 and 6, the first scan driver 301A and the second scan driver 302A may be connected to the pixels (or the display panel 100) through a plurality of scan lines.

The first scan driver 301A may sequentially provide the scan signals to the first and second display areas DA1 and DA2. The first display area DA1 may have a foldable area. The second display area DA2 may not have the foldable area. In some embodiments, as illustrated in FIG. 6, odd scan lines SL1, SL3, . . . , SLn−1, SLn+1, . . . , SL2*n*−1 may be connected to the first scan driver 301A. Thus, when the first scan driver 301A operates, odd pixel rows may emit light. The first scan driver 301A may operate only when the display panel 100 is unfolded.

The second scan driver 302A may sequentially provide the scan signals to the second display area and DA2. In some embodiments, as illustrated in FIG. 6, (N+1)-th to 2N-th scan lines SLn+1 to SL2*n* may be connected to the second scan driver 302A. Thus, when the second scan driver 302A operates, the pixels in the second display area DA2 may emit light. The second scan driver 302A may operate only when the display panel 100 is folded.

The foldable display device 3000 may not apply the scan signals and data signals to the first display area DA1 which is not viewed by the user when the display panel 100 is folded or bent. Thus, the overall power consumption may be reduced.

The present embodiments may be applied to any display device having a flexible display panel and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A foldable display device, comprising:

a flexible display panel including a plurality of pixels corresponding to first to 2N-th scan lines, and including a first display area having at least partially foldable area and a second display area not having the foldable area;

a folding sensor disposed in the first display area and configured to detect a folding status of the flexible display panel and output a detecting signal indicating whether the flexible display panel is folded or unfolded;

a first scan driver connected to either odd scan lines or even scan lines among the first to 2N-th scan lines and configured to sequentially provide scan signals to the scan lines connected to the first scan driver in response to the detecting signal;

a second scan driver connected to all scan lines in the second display area among the first to 2N-th scan lines and not connected to any scan line in the first display area, and configured to sequentially provide the scan signals to the scan lines connected to the second scan driver in response to the detecting signal;

a data driver configured to provide data signals to the flexible display panel in response to the detecting signal; and a timing controller configured to convert input image data in response to the detecting signal and control the first scan driver, the second scan driver, and the data driver, where N is a positive integer, wherein the first scan driver operates exclusively when the folding sensor determines that the flexible display panel is unfolded and the second scan driver operates exclusively when the folding sensor determines that the flexible display panel is folded.

2. The device of claim 1, wherein the scan signals are applied to the scan lines connected to the first scan driver such that an image displays on the first display area and the second display area when the folding sensor determines that the flexible display panel is unfolded.

3. The device of claim 2, wherein a number of the scan lines connected to the first scan driver-is the same as a number of the scan lines connected to the second scan driver.

4. The device of claim 2, wherein the image is displayed on the first display area and the second display area when the first scan driver operates.

5. The device of claim 2, wherein the image is displayed on the second display area when the second scan driver operates, and wherein the data signals are not transmitted to the first display area when the second scan driver operates.

* * * * *